US010234168B2

(12) United States Patent
Minter et al.

(10) Patent No.: US 10,234,168 B2
(45) Date of Patent: Mar. 19, 2019

(54) MULTI-TUBE OFFSET PRE-INSULATED HVAC DUCTING TECHNOLOGY

(71) Applicant: AQC Industries, LLC, Shoreview, MN (US)

(72) Inventors: Sterling P. Minter, Pitman, NJ (US); James M. Lubratt, Shoreview, MN (US)

(73) Assignee: AQC INDUSTRIES, LLC, Shoreview, MN (US)

( * ) Notice: Subject to any disclaimer, the term of this patent is extended or adjusted under 35 U.S.C. 154(b) by 0 days.

(21) Appl. No.: 15/081,259

(22) Filed: Mar. 25, 2016

(65) Prior Publication Data

US 2017/0276394 A1 Sep. 28, 2017

(51) Int. Cl.
*F24F 13/02* (2006.01)

(52) U.S. Cl.
CPC ..... *F24F 13/0281* (2013.01); *F24F 13/0209* (2013.01); *F24F 13/0263* (2013.01)

(58) Field of Classification Search
CPC . F24F 13/0209; F24F 13/0263; F24F 13/0281
USPC ..... 138/109, 114, 140, 137, 149, 155, 177, 138/DIG. 4
See application file for complete search history.

(56) References Cited

U.S. PATENT DOCUMENTS

| | | | |
|---|---|---|---|
| 132,475 | A | 10/1872 | Linville |
| 3,543,804 | A | 12/1970 | Ziegler |
| 3,630,549 | A | 12/1971 | Grimm |
| 3,776,253 | A | 12/1973 | Yamaguchi et al. |
| 3,889,581 | A | 6/1975 | Bray, Sr. |
| 4,249,578 | A | 2/1981 | Freeman |
| 6,116,833 | A | 9/2000 | Ellis |
| 6,203,074 | B1 | 3/2001 | Daniel |
| 6,360,783 | B2 | 3/2002 | Faverio, IV et al. |
| 6,901,969 | B2 | 6/2005 | Siiter |

(Continued)

FOREIGN PATENT DOCUMENTS

FR 2238022 A1 * 2/1975 ..... F16L 9/16

OTHER PUBLICATIONS

Translation of FR 2238022.*

(Continued)

*Primary Examiner* — Craig Schneider
*Assistant Examiner* — David Deal
(74) *Attorney, Agent, or Firm* — Fredrikson & Byron, P.A.

(57) ABSTRACT

The invention provides an HVAC duct having an inner composite tube and an outer composite tube. The inner composite tube has an interior metal wall, a primary foam wall, and an exterior metal wall. The outer composite tube has an interior metal wall, a secondary foam wall, and an exterior metal wall. In certain embodiments, the inner composite tube is nested inside the outer composite tube in an end-offset configuration. In these embodiments, the first end of the duct defines a male detent having a radially-outward-facing metal engagement face projecting beyond the interior metal wall of the outer composite tube, whereas the second end of the duct defines a female detent having a radially-inward-facing metal engagement face projecting beyond the exterior metal wall of the inner composite tube. Also provided is an HVAC ductwork assembly wherein two ducts of the described nature are connected in an advantageous end-to-end manner.

30 Claims, 7 Drawing Sheets

(56) References Cited

U.S. PATENT DOCUMENTS

| | | | | |
|---|---|---|---|---|
| 7,044,171 | B2 | 5/2006 | Betley et al. | |
| 7,624,762 | B2 | 12/2009 | Cohen et al. | |
| 7,699,078 | B1 * | 4/2010 | Husmann, Jr. | F16L 59/04 138/114 |
| 8,667,995 | B1 * | 3/2014 | Fanelli | F24F 13/0245 138/112 |
| 9,074,788 | B2 | 7/2015 | Duffy | |
| 9,476,525 | B2 | 10/2016 | Tarpy et al. | |
| 9,816,644 | B2 | 11/2017 | Tarpy et al. | |
| 2003/0011290 | A1 * | 1/2003 | Austin | F24F 3/0442 312/326 |
| 2003/0051764 | A1 | 3/2003 | Jungers | |
| 2008/0045137 | A1 | 2/2008 | Rosal | |
| 2011/0030833 | A1 | 2/2011 | Griggio | |
| 2013/0074947 | A1 | 3/2013 | Murchie | |
| 2015/0267937 | A1 | 9/2015 | Duffy | |

OTHER PUBLICATIONS

"3M VentureClad Insulation Jacketing Tapes: 1577 Series," Technical Data, 3M Company, Dec. 2015, 4 pages.
"PalDuct Phenolic System," Product Catalogue, Kingspan, Issue 1, Apr. 2015, 10 pages.
English Human Translation of French Publication No. 2238022 A1, published Feb. 14, 1975, 3 pages.

* cited by examiner

MULTI-TUBE OFFSET PRE-INSULATED HVAC DUCTING TECHNOLOGY

FIELD OF THE INVENTION

The present invention relates generally to HVAC ducts. More particularly, this invention relates to pre-insulated HVAC ducts.

BACKGROUND OF THE INVENTION

Conventional HVAC ductwork has a variety of limitations. It may have suboptimal thermal insulation properties and/or be non-uniform in terms of thermal insulation properties over its length. In some cases, there may be more air and/or water leakage than is desired. Further, certain ductwork systems include materials that are ideally not exposed to the air circulated within a building. Still further, conventional ductwork may not be as durable as would be optimal. Moreover, some HVAC ductwork is heavy, expensive, or difficult to install. With respect to outdoor ductwork, which is just one relevant category of HVAC ductwork, some ducts are not pre-insulated, and may therefore necessitate having an insulation subcontractor apply thermal insulation to the installed ductwork.

It would be desirable to provide a duct construction, a ductwork assembly, and a ductwork system that address one or more of the foregoing problems associated with conventional ductwork.

SUMMARY OF THE INVENTION

Figure 1:
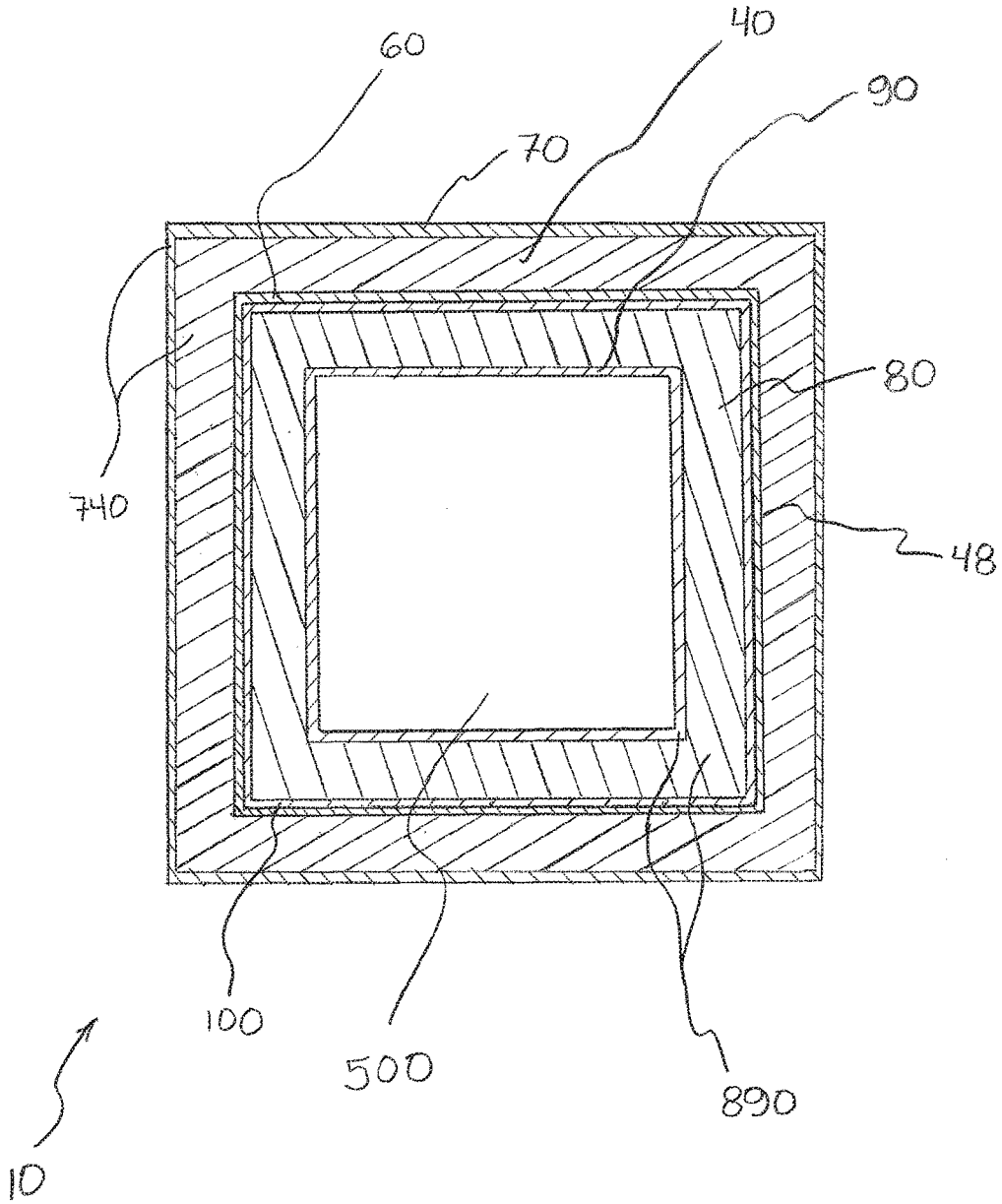
FIG. 1 is a cross-sectional view of a duct in accordance with certain embodiments of the present invention.

In some embodiments, the invention provides an HVAC duct having opposed first and second ends and a central span extending between the first and second ends. The HVAC duct includes an inner composite tube and an outer composite tube. The inner composite tube has an interior metal wall, a primary foam wall, and an exterior metal wall. The primary foam wall is bonded to both the interior and exterior metal walls of the inner composite tube. The outer composite tube has an interior metal wall, a secondary foam wall, and an exterior metal wall. The secondary foam wall is bonded to both the interior and exterior metal walls of the outer composite tube. The inner composite tube is nested inside the outer composite tube in an end-offset configuration characterized by the inner composite tube projecting axially beyond the outer composite tube at the first end of the duct, whereas at the second end of the duct the outer composite tube projects axially beyond the inner composite tube. Thus, the first end of the duct defines a male detent having a radially-outward-facing metal engagement face projecting axially beyond the interior metal wall of the outer composite tube, whereas the second end of the duct defines a female detent having a radially-inward-facing metal engagement face projecting axially beyond the exterior metal wall of the interior composite tube.

Certain embodiments of the invention provide an HVAC ductwork assembly comprising a first duct and a second duct. The first duct has opposed first and second ends and a central span extending between the first and second ends. The first duct includes an inner composite tube and an outer composite tube. The inner composite tube has an interior metal wall, a primary foam wall, and an exterior metal wall. The primary foam wall is bonded to the interior and exterior metal walls of the inner composite tube. The outer composite tube has an interior metal wall, a secondary foam wall, and an exterior metal wall. The secondary foam wall is bonded to both the interior and exterior metal walls of the outer composite tube. The inner composite tube is nested inside the outer composite tube in an end-offset configuration characterized by the inner composite tube projecting beyond the outer composite tube at the first end of the first duct, whereas at the second end of the first duct the outer composite tube projects beyond the inner composite tube. Thus, the first end of the first duct defines a male detent having a radially-outward-facing metal engagement face projecting axially beyond the interior metal wall of the outer composite tube of the first duct, whereas the second end of the first duct defines a female detent having a radially-inward-facing metal engagement face projecting axially beyond the exterior metal wall of the inner composite tube of the first duct. The second duct has opposed first and second ends and a central span extending between the first and second ends. The second duct includes an inner composite tube and an outer composite tube. The inner composite tube has an interior metal wall, a primary foam wall, and an exterior metal wall. The primary foam wall is bonded to the interior and exterior metal walls of the inner composite tube. The outer composite tube has an interior metal wall, a secondary foam wall, and an exterior metal wall. The secondary foam wall is bonded to the interior and exterior metal walls of the outer composite tube. The inner composite tube is nested inside the outer composite tube in an end-offset configuration characterized by the inner composite tube projecting beyond the outer composite tube at the first end of the second duct, whereas at the second end of the second duct the outer composite tube projects beyond the inner composite tube. Thus, the first end of the second duct defines a male detent having a radially-outwardly-facing metal engagement face projecting axially beyond the interior metal wall of the outer composite tube, whereas the second end of the second duct defines a female detent having a radially-inwardly-facing metal engagement face projecting axially beyond the exterior metal wall of the inner composite tube. In the present embodiments, the first duct and the second duct are joined together by a connection characterized by the male detent of the first duct being received in the female detent of the second duct, such that the exterior metal wall of the inner composite tube of the first duct is nested inside, so as to contact, the interior metal wall of the outer composite tube of the second duct.

In certain embodiments, the invention provides an HVAC duct having opposed first and second ends and a central span extending between the first and second ends. The HVAC duct includes an inner composite tube, an outer composite tube, and an outermost composite tube. The inner composite tube has an interior metal wall, a primary foam wall, and an exterior metal wall. The primary foam wall is bonded to both the interior and exterior metal walls of the inner composite tube. The outer composite tube has an interior metal wall, a secondary foam wall, and an exterior metal wall. The secondary foam wall is bonded to both the interior and exterior metal walls of the outer composite tube. The outermost composite tube has an interior metal wall, a tertiary foam wall, and an exterior metal wall. The tertiary foam wall is bonded to both the interior and exterior metal walls of the outermost composite tube. The inner composite tube is nested inside the outer composite tube, and the outer composite tube is nested inside the outermost composite tube. These three composite tubes are secured in an end-offset configuration characterized by a desired one of the three composite tubes projecting axially beyond the other two of the three composite tubes at the first end of the duct, whereas at the second end of the duct the other two of the three composite tubes project axially beyond the desired one of the three composite tubes. Thus, a leading one of the first and second ends of the duct defines a male detent, while a trailing one of the first and second ends of the duct defines a female detent. The male detent includes a radially-outward-facing metal engagement face. The female detent includes a radially-inward-facing metal engagement face. In some the present embodiments, the female detent includes an axially-outward-facing open pocket surrounded by the radially-inward-facing metal engagement face. Preferably, two of the three composite tubes are in flush-end positions characterized by those two composite tubes being substantially flush with each other at both the first and second ends of the duct. In some cases, the HVAC duct is part of an HVAC ductwork assembly that further includes another duct (these two ducts being defined as first and second ducts). In such cases, the first and second ducts are joined together by a connection characterized by the male detent being received in the female detent such that the radially-outward-facing metal engagement face of the male detent is nested inside, so as to contact, the radially-inward-facing metal engagement face of the female detent.

DETAILED DESCRIPTION OF PREFERRED EMBODIMENTS

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the examples provided herein have many useful alternatives that fall within the scope of the invention.

The invention provides a pre-insulated HVAC duct that has exceptional thermal insulation properties and durability. In addition, the duct has an extremely light weight composition, and it has a special multi-tube, multi-wall construction that offers numerous advantages.

Figure 2:
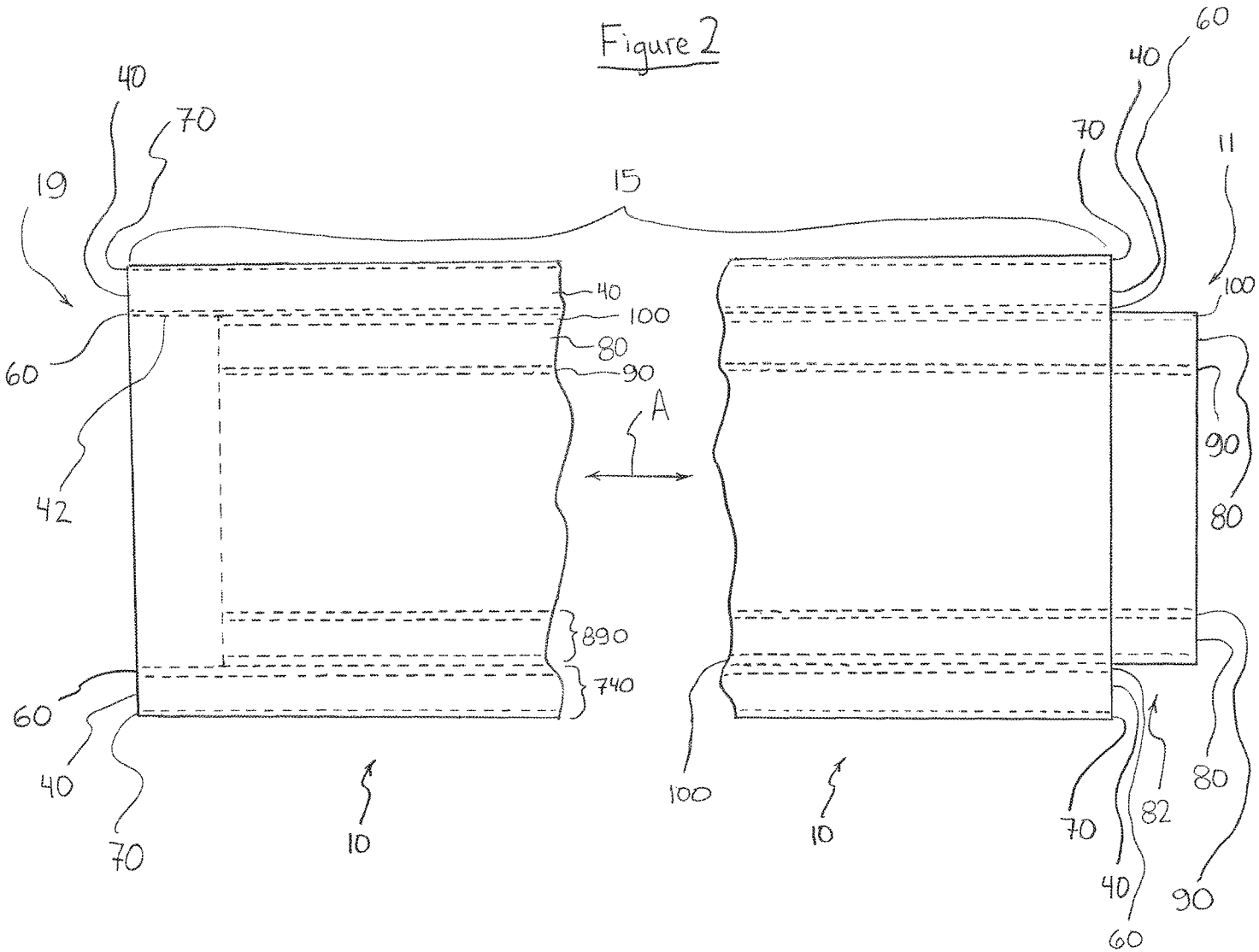
FIG. 2 is a broken-away side view of the duct of FIG. 1.

As shown in FIG. 2, the duct 10 has opposed first 11 and second 19 ends and a central span 15 extending therebetween. The length of the duct 10 can be varied to accommodate the requirements of different applications. Typically, the duct 10 will have a length of between 1 and 18 feet. In some cases, the length is between 3 and 13 feet. The duct 10 may, for example, have a length of about 4 feet, about six feet, about 8 feet, about 10 feet, or about 12 feet. These examples are by no means limiting. In other embodiments, the duct 10 has a length of between 3 inches and 2 feet, such as between 4 inches and 1.5 feet. In such embodiments, the duct 10 may, for example, have a length of about 6 inches or about one foot.

The duct 10 includes an inner composite tube 890 and an outer composite tube 740. The inner composite tube 890 has an interior metal wall 90, a primary foam wall 80, and an exterior metal wall 100. The primary foam wall 80 is bonded to both the interior 90 and exterior 100 metal walls of the inner composite tube 890. In the present disclosure, the term bonded is used to refer to two walls that are integrally affixed to each other by chemical, adhesive, and/or mechanical means. Thus, the interior metal wall 90, primary foam wall 80, and exterior metal wall 100 of the inner composite tube 890 collectively form a single unitary multi-wall tube 890.

The outer composite tube 740 has an interior metal wall 60, a secondary foam wall 40, and an exterior metal wall 70. The secondary foam wall 40 is bonded to both the interior 60 and exterior 70 metal walls of the outer composite tube 740. Thus, the interior metal wall 60, secondary foam wall 40, and exterior metal wall 70 collectively form a single unitary multi-wall tube 740.

Each metal wall of the duct 10 preferably has a thickness of between 10 micrometers and 2,600 micrometers, such as between 15 micrometers and 300 micrometers. The metal walls of the duct 10 need not all have the same thickness. In one non-limiting example, metal wall 90 has a thickness of about 60 micrometers, and metal wall 100 has a thickness of about 200 micrometers. In addition, metal wall 60 can optionally have a thickness in the range of 50-90 micrometers, while metal wall 70 has a thickness in the range of 50-250 micrometers. In one non-limiting example, metal wall 60 has a thickness of about 60 micrometers, while metal wall 70 has a thickness of about 60 micrometers. In another non-limiting example, metal wall 60 has a thickness of about 80 micrometers, while metal wall 70 has a thickness of about 80 micrometers. In still another non-limiting example, metal wall 60 has a thickness of about 60 micrometers, while metal wall 70 has a thickness of about 200 micrometers.

The inner composite tube 890 is nested inside the outer composite tube 740 in an end-offset configuration characterized by the inner composite tube projecting axially beyond the outer composite tube at the first end 11 of the duct 10, whereas at the second end 19 of the duct the outer composite tube projects axially beyond the inner composite tube. This can be appreciated by referring to FIG. 2. Here, the first end 11 of the duct 10 defines a male detent having a radially-outward-facing metal engagement face 82 projecting axially beyond the interior metal wall 60 of the outer composite tube 740, whereas the second end 19 of the duct defines a female detent having a radially-inward-facing metal engagement face 42 projecting axially beyond the exterior metal wall 100 of the inner composite tube 890.

The inner composite tube 890 is nested inside the outer composite tube 740 (e.g., by virtue of a friction-fit, glue, tape, and/or mechanical fastener assembly) such that the exterior metal wall 100 of the inner composite tube and the interior metal wall 60 of the outer composite tube contact each other. A preferred concentric nesting arrangement can be appreciated by referring to FIGS. 1-3. Here, it is to be appreciated that the inner composite tube 890 and the outer composite tube 740 preferably are affixed to each other so as to be locked against relative axial or rotational movement relative to each other.

Figure 4:
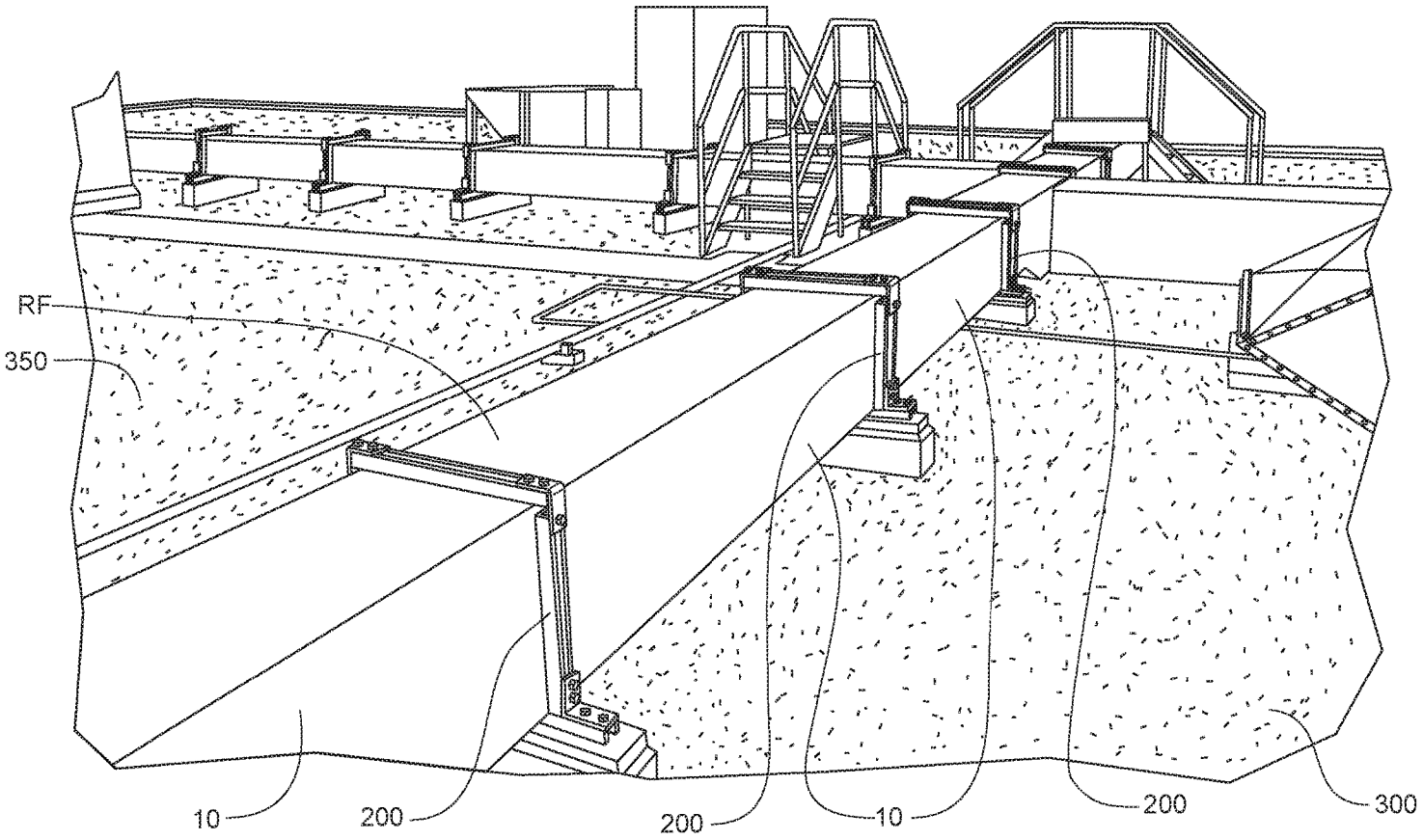
FIG. 4 is a perspective view of a building provided with an outdoor ductwork system in accordance with certain embodiments of the invention.
Figure 5:
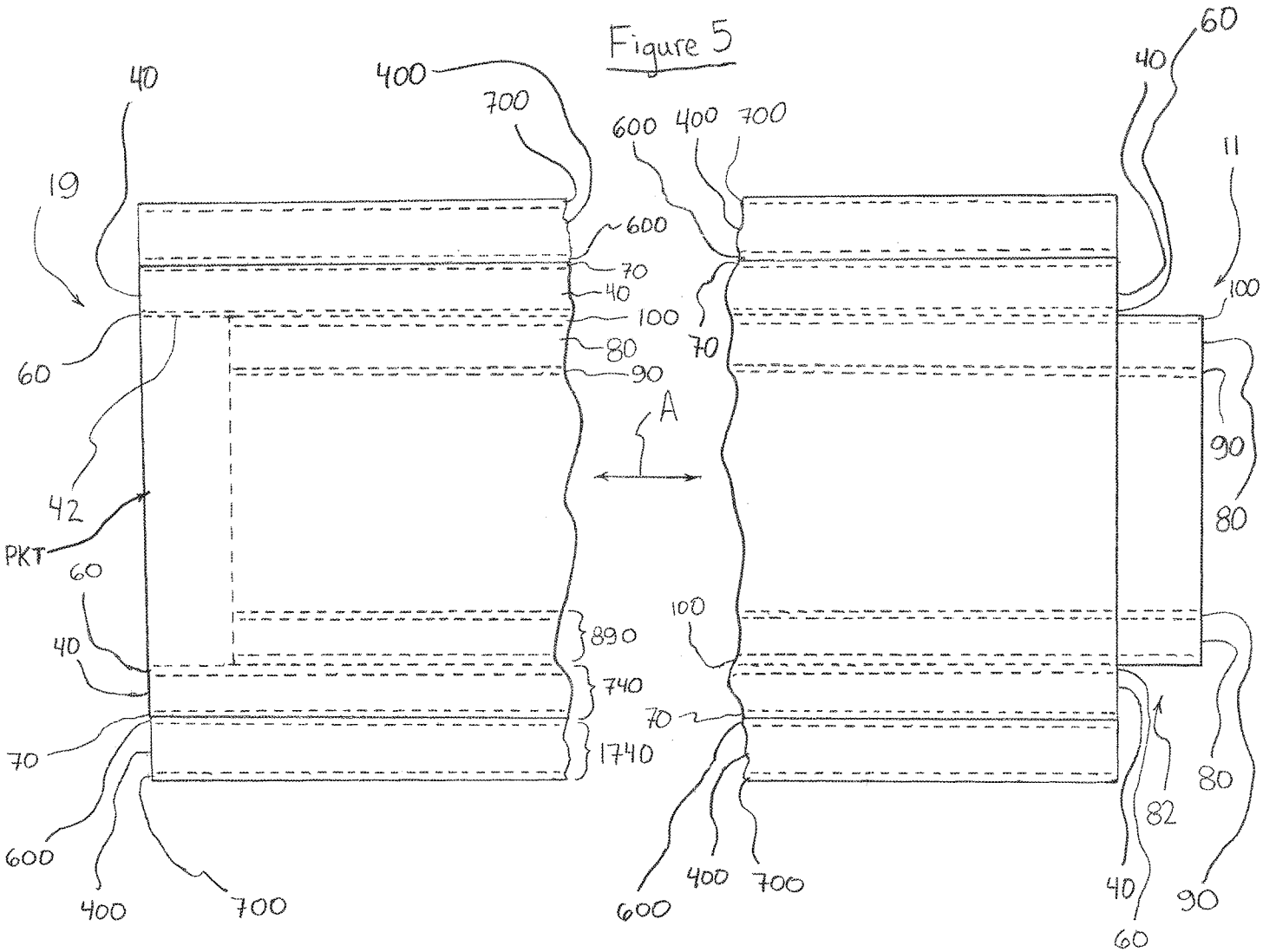
FIG. 5 is a broken-away side view of a duct in accordance with certain embodiments of the invention.

The duct 10 is elongated along a longitudinal axis, which is depicted in FIGS. 2 and 5 by two-sided arrow A. In the embodiments of FIGS. 1 and 4, the inner composite tube 890 and the outer composite tube 740 each have a square or rectangular configuration in a cross-section taken perpendicular to the longitudinal axis A of the duct 10. In other embodiments, the inner composite tube and the outer composite tube each have a circular configuration in a cross-section taken perpendicular to the longitudinal axis of the duct.

Figure 7B:
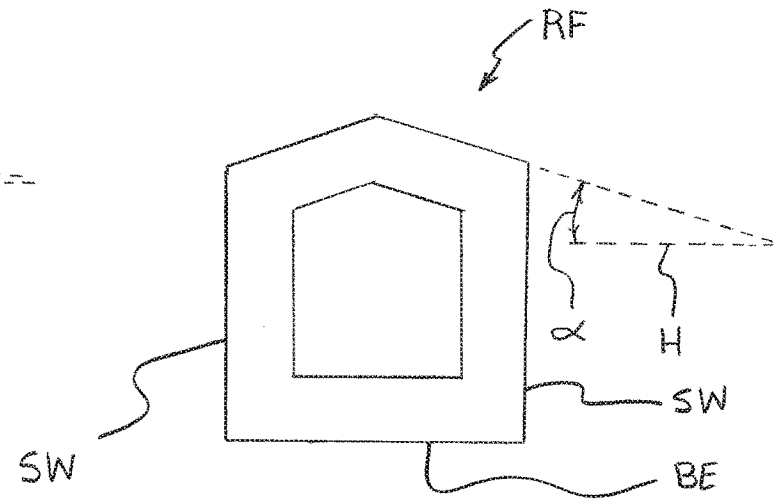
FIG. 7B is a schematic end view of a duct in accordance with other embodiments of the present invention.
Figure 7A:
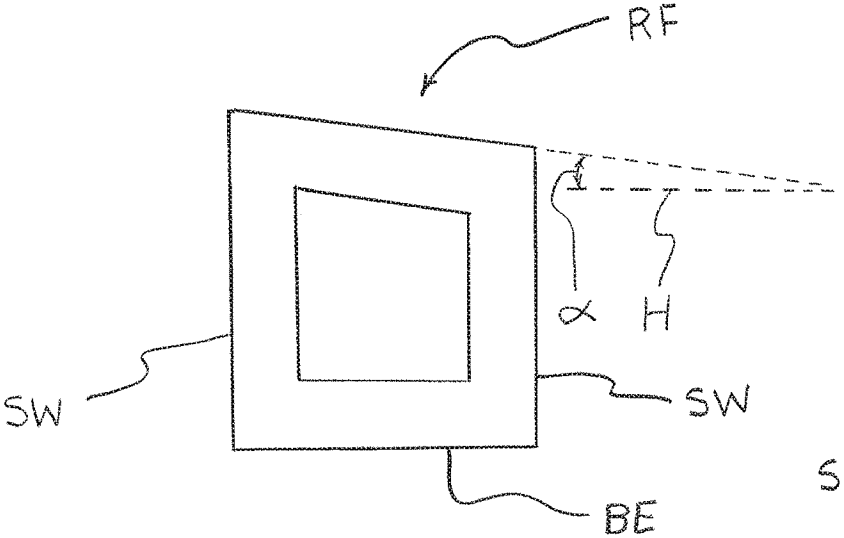
FIG. 7A is a schematic end view of a duct in accordance with certain embodiments of the present invention.

FIGS. 7A and 7B schematically depict two non-limiting embodiments wherein the duct 10 has a sloped roof RF. Here, the roof RF of the duct 10 is intended to define the top (i.e., the upwardly facing side) of the duct 10 when installed in its operative position as part of a ductwork system. The upward orientation of a duct roof RF can be appreciated with reference to FIG. 4. Note that the duct roof shown in FIG. 4 is not sloped, but rather is parallel to the duct base and to a horizontal axis.

A sloped (or "inclined") duct roof RF can provide advantageous levels of watershed, e.g., of rain or other precipitation in cases where the duct is mounted outdoors. In the embodiment of FIG. 7A, the roof RF has a single face extending (at a constant angle $\alpha$) entirely between the two sides SW of the duct 10. In the embodiment of FIG. 7B, the roof RF has two faces each extending at an angle $\alpha$ relative to a horizontal axis H. Thus, the duct roof RF can optionally have a gable. In embodiments where the duct roof includes at least one sloped face, the noted angle $\alpha$ can be varied to accommodate different applications. The angle (or "pitch") may range, for example, from about 5 to about 30 degrees. It is to be appreciated that while certain embodiments provide the duct with a sloped roof, this is by no means required.

With continued reference to FIGS. 7A and 7B, it can be appreciated that, in certain embodiments, the duct 10 includes a roof RF, base BE, and two sides SW. Here, the roof RF and base BE are generally opposed; the same is true of the two illustrated sides SW. The base BE of the duct 10 is intended to define the bottom (i.e., the downwardly facing side) of the duct when installed in its operative position as part of a ductwork system.

While not strictly required, the inner composite tube 890 preferably has substantially the same length as the outer composite tube 740. The term "substantially the same" as used herein means no more than 10% different. It is to be understood that the inner 890 and outer 740 composite tubes of the duct 10 can in some cases initially have lengths that differ by more than 10%. In such cases, however, one or both of these tubes would typically be cut down, or "trimmed," such that the two resulting trimmed tubes have the same length. In many cases, it will be preferred that all the tubes of the duct 10 be of identical length, or at least within 5% of each other, at least once two such ducts are connected (e.g., in embodiments where two such ducts are operably connected to each other, as in FIG. 3).

Referring to FIG. 2, the interior metal wall 90, primary foam wall 80, and exterior metal wall 100 of the inner composite tube 890 preferably all have substantially the same length. In addition, the interior metal wall 60, secondary foam wall 40, and exterior metal wall 70 preferably all have substantially the same length. One advantage of such arrangements is that the duct 10 has a continuous interior metal facing. Thus, metal can define the entire interior surface area that will be exposed to air flowing through the interior passage 500 of the duct 10.

Figure 3:
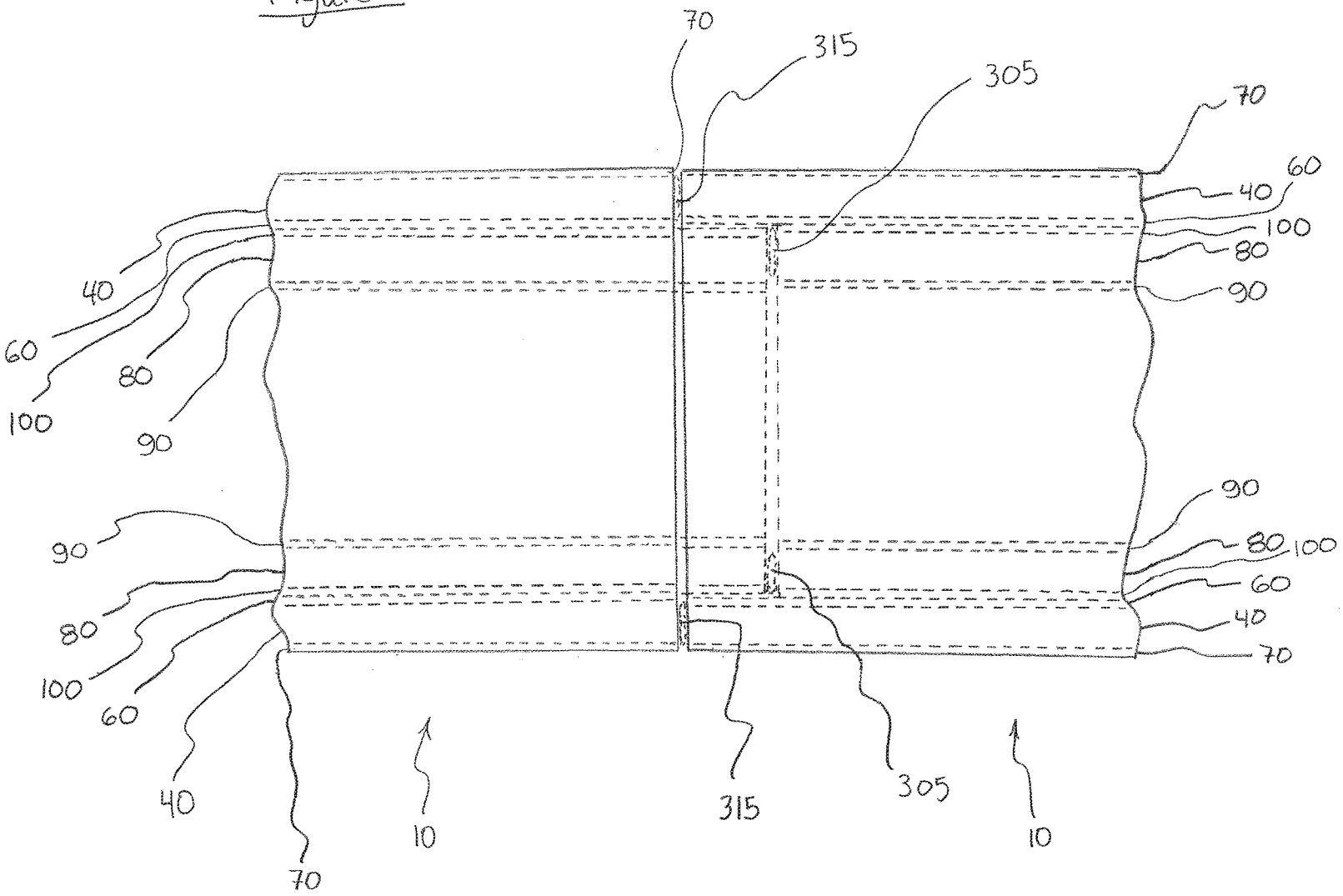
FIG. 3 is a broken-away side view of a connection between two ducts in accordance with certain embodiments of the invention.

In FIGS. 1-3, between the innermost metal facing 90 and the outermost metal facing 70 there are two separate layers of foam. Each of these foam layers provides a thermal break, e.g., through which there is no thermal pathway defined by metal connecting the innermost 90 and outermost 70 metal walls.

The walls of the duct 10 desirably are devoid of microfibers. Preferably, the entire duct 10 is devoid of microfibers. In addition, the walls of the duct 10 desirably are devoid of both CFC (i.e., chlorofluorocarbon) and HCFC (i.e., hydrochlorofluorocarbon). Preferably, the entire duct 10 is devoid of both CFC and HCFC.

The foam walls of the duct 10 are self-supporting and preferably are rigid (i.e., not capable of being wound). They preferably comprise a polymer foam. In preferred embodiments, phenolic foam is used, although polyurethane foam or other types of rigid foam can alternatively be used.

The foam walls of the duct 10 preferably each have a thickness in the range of 10-100 mm, such as 15-60 mm. In one non-limiting example, the foam walls each have a thickness of about 20 mm. In another non-limiting example, the foam walls each have a thickness of about 30 mm. In still another non-limiting example, the foam walls each have a thickness of in the range of about 40-45 mm.

In the embodiment of FIG. 2, the duct 10 includes six walls 40, 60, 70, 80, 90, 100. Preferably, four of the walls 60, 70, 90, 100 are metal while two other walls 40, 80 comprise a polymer foam. In FIG. 2, the duct 10 has, moving in a radially outward direction from the longitudinal axis of the duct, no more than two foam walls (i.e., no more than two layers of foam) and no more than four rigid metal walls (i.e., no more than four rigid layers of metal).

In other embodiments, the duct includes nine walls. Reference is made to the embodiment of FIG. 5. Preferably, six of the walls 60, 70, 90, 100, 600, 700 are metal while three other walls 40, 80, 400 comprise a polymer foam. In FIG. 5, the duct 10 has, moving in a radially outward direction from the longitudinal axis of the duct, no more than three foam walls (i.e., no more than three layers of foam) and no more than six rigid metal walls (i.e., no more than six rigid layers of metal).

The foam walls may, for example, comprise (or consist of, or at least consist essentially of) a phenolic resin.

In addition to the noted foam walls and metal walls, the duct 10 can optionally have an outer jacketing material. In some embodiments, the jacketing material forms a vapor barrier that envelopes the entire perimeter, and the entire length, of the duct 10. The jacketing material can be a multi-layer laminate that includes an adhesive facing (e.g., a layer of acrylic adhesive). In the embodiment of FIG. 1, the optional jacketing material can be adhesively applied over the exterior metal wall 70 of the outer composite tube 740. In the embodiment of FIG. 5, the optional jacketing material can be adhesively applied over the exterior metal wall 700 of the outermost composite tube 1740. One useful jacketing material is the 3M™ VentureClad™ 1577 CW Insulation Jacketing, which is sold commercially by 3M of St. Paul, Minn. In other embodiments, the jacketing material simply comprises a plastic liner, which may envelope the entire perimeter, and the entire length, of the duct 10.

Preferably, each of the duct's metal walls comprises aluminum. While aluminum is preferred, another aircraft metal can alternatively be used. The aircraft metal can be selected from the group consisting of aluminum, titanium, beryllium, magnesium, and alloys comprising one or more of these metals. In other cases, steel may be used.

In certain embodiments, the inner composite tube 890 has metal interior 90 and exterior 100 walls, while the outer composite tube 740 has paper or cardboard liner in place of the metal interior wall 60 and/or in place of the metal exterior wall 70. In embodiments where the duct 10 includes three composite tubes 890, 740, 1740, the outermost composite tube 1740 can optionally have paper or cardboard liner in place of the metal wall 600 and/or in place of metal wall 700.

The foam layers of the duct 10 can optionally have a density in the range of from 40 to 80 kg/m$^3$, such as in the range of from 50-70 kg/m$^3$. In one non-limiting example, the density is about 60 kg/m$^3$.

In preferred embodiments, the interior metal wall 90, the primary foam wall 80, and the exterior metal wall 100 of the inner composite tube 890, as well as the interior metal wall 60, the secondary foam wall 40, and the exterior metal wall 70 of the outer composite tube 740, all have substantially the same length. In many cases, these four walls will all have the same length, or at least be within 5% of one another. This will typically be the case once two ducts 10 are connected, such as in embodiments that provide two such ducts operably connected to each other. Reference is made to FIG. 3.

The present duct 10 provides exceptional thermal insulation properties. For example, the duct 10 preferably has an R value of at least 6. In some embodiments, the R value is at least 8. In one non-limiting example, the R value is about 10. In other embodiments, the R value is at least 11. In one non-limiting example, the R value is about 12. In still other embodiments, the R value is at least 14. In one non-limiting example, the R value is about 15. In another non-limiting example, the R value is about 18. The R value of the present duct can be determined using conventional methodology, e.g., in accordance with the well-known ASTM C518 standard for measuring R value, the salient teachings of which are incorporated herein by reference.

In addition to providing exceptional thermal insulation, the present HVAC duct 10 has an advantageous light-weight construction. Preferably, the duct 10 has a weight per unit surface area of less than 3 pounds per square foot of surface area. In some embodiments, the duct 10 has a weight per unit surface area of less than 2 pounds per square foot of surface area. In one non-limiting example, the duct has a weight per unit surface area of about 1.1 pound per square foot of surface area.

One non-limiting method of making the duct will now be described. The duct, as shown on a set of mechanical plans designed by a building engineer, is electronically traced with a CAD (Computer Aided Design) software package, such as that available commercially from AutoDesk under the name of Estimator MEP. The software has been programmed to calculate the amount and configuration of duct panels to be used to make the designed ductwork. Suitable duct panels are available commercially from PAL System International FZCO, of Dubai, U.A.E., e.g., under the tradename Kingspan PalDuct Phenolic panels. The program will output a bill of material that is then programmed into a "SuperCut" software system that is designed to optimize the duct panels for minimal waste of product to produce a projects ductwork. The SuperCut program also controls a CNC (Computer Numerically Controlled) machine. The CNC machine can be, for example, obtained commercially from Alarsis Corte Industrial S.L., of Murcia Spain. The CNC machine has a cutting blade that operates in 5 axes: depth, width, length, blade angle and blade rotation. The CNC machine will follow the program to cut the duct panels as needed to manufacture the duct system. If a duct is of a size where multiple walls of the duct can be used from one panel, the panel will be cut in two (2) 45 degree cuts that form a "V" cut where the bottom aluminum liner is not cut. This allows the panel to be folded from a flat panel into a rectangular duct system. With respect to ducts of larger size that require the side walls to each be made from a different panel, the CNC machine will cut a 45 degree bevel cut and will cut through the bottom aluminum liner. Then the multiple panels each having a 45 degree bevel cut will be assembled into a rectangular duct.

Once one duct (i.e., the interior composite tube 890) is assembled, the CNC machine is programmed to make a 2$^{nd}$ duct (i.e., the outer composite tube 740) such that the inside dimensions exactly match the outside dimension of the inside duct. The 2$^{nd}$ duct is then manufactured around an inside duct in such a manner that the inside duct protrudes at one end by about 3" (male end) and the exterior duct protrudes by 3" (female end) on the other end of the duct. The two ducts can be connected by friction fit, sealant, glue, and/or double side tape. The exterior duct is then covered with a plastic liner to protect the duct from visible damage, hail, and/or other items that could dent the outer duct. This plastic liner is applied with a double sided tape. The duct with the plastic liner is then wrapped with the 3M VentureClad 1577 product to complete an air-and-water-tight outer jacketing for the duct system. The VentureClad has a self-adhesive backing to adhere it to the plastic liner. It is to be appreciated that this method is merely exemplary; the foregoing details are by no means limiting to the invention. Other methods can be used to manufacture the various duct embodiments described herein.

The invention also provides embodiments wherein two ducts 10 in accordance with the invention are operably connected to each other. Reference is made to FIG. 3. While FIG. 3 shows the connection between two ducts that each have only two composite tubes 890, 740, the following discussion also applies to the connection between two ducts that each include three composite tubes 890, 740, 1740 (like those shown in FIGS. 5-6C).

The two ducts 10 are connected to each other in an end-to-end arrangement. In FIG. 3, it is to be appreciated that the dimensions of the illustrated sealant beads 305, 315 are not necessarily to scale, but rather are shown with dimensions that enable their illustration. Similarly, the resulting gaps between the confronting butt ends of the two ducts are not necessarily to scale, but rather are shown with dimensions that enable illustration of the sealant beads 305, 315.

The first duct 10 and the second duct 10 are joined together by a connection characterized by the male detent of the first duct being received in the female detent of the second duct. In the embodiment of FIG. 3, the exterior metal wall 100 of the inner composite tube 890 of the first duct 10 is nested inside, so as to contact, the interior metal wall 60 of the outer composite tube 740 of the second duct 10.

The connection preferably includes a radial inner interface, an axial interface, and a radial outer interface. The axial interface desirably extends between the radial inner interface and the radial outer interface. In the embodiment of FIG. 3, the radial inner interface is located between the primary foam wall 80 of the inner composite tube 890 of the first duct 10 and the primary foam wall 80 of the inner composite tube 890 of the second duct 10. Preferably, sealant 305 is provided at the radial inner interface. With continued reference to the embodiment of FIG. 3, the axial interface comprises contact between the exterior metal wall 100 of the inner composite tube 890 of the first duct 10 and the interior metal wall 60 of the outer composite tube 740 of the second duct 10. In the embodiment of FIG. 3, the radial outer interface is located between the secondary foam wall 40 of the outer composite tube 740 of the first duct 10 and the secondary foam wall 40 of the outer composite tube 740 of the second duct 10. Preferably, sealant 315 is provided at the radial outer interface.

Figure 6A:
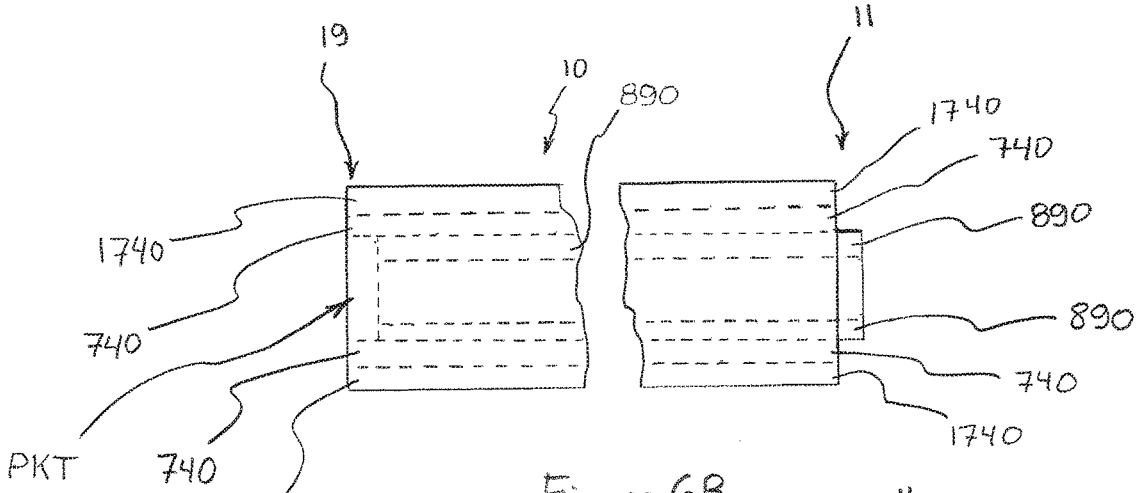
FIG. 6A is a schematic broken-away side view of the duct of FIG. 5.
Figure 6B:
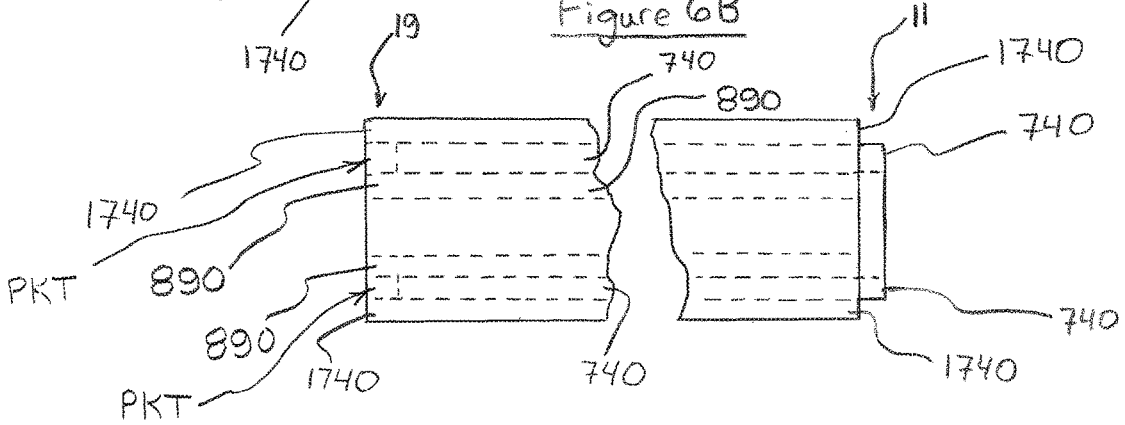
FIG. 6B is a schematic broken-away side view of a duct in accordance with another embodiment of the invention.

Thus, the connection preferably includes first 305 and second 315 beads of sealant. In the embodiment of FIG. 6B, it may be desirable to provide three beads of sealant. In the foregoing embodiments, high performance silicone sealant can be used. Suitable sealant of this nature is available commercially from PAL System International FZCO, of Dubai, U.A.E. Preferably, each bead of sealant is continuous. As shown in FIG. 3, the first 305 and second 315 sealant beads preferably are positioned at locations that are spaced apart both axially and radially. In the embodiment illustrated, for example, the first bead of sealant 305 is located at the radial inner interface, and the second bead of sealant 315 is located at the radial outer interface.

In the method of connecting the two ducts 10 shown in FIG. 3, two beads of sealant are applied respectively on the projecting end of the inner composite tube 890 and on the projecting end of the outer composite tube 740. The male end of the first duct 10 is then pressed into the female end of the second duct 10. The two ducts 10 will seat and seal with a moderate amount of pressure. This will result in a male-female style connection characterized by an end region of the outer composite tube 740 of the second duct 10 overlapping an end region of the inner composite tube 890 of the first duct 10. While the desired overlap dimension can be varied to accommodate different applications, the overlap dimension preferably is in the range of 1 inch to five inches, such as 2-4 inches. In one non-limiting example, the overlap is about 3 inches. In some cases, a rubber mallet or another tool is then used to tap tiger clips (or other suitable fasteners) into both ducts to further secure the connection. UL181 tape is preferably then applied over the tiger clips and the connection (or "duct seam"). Half the width of the tape preferably is on each side of the duct seam. It may be desirable to have the overlap of the tape be on the bottom, or a side, of the duct. If it is on a side of the duct, however, it may be desirable that the overlap face down to maximize water shedding. Next, a squeegee is advantageously used to apply friction to the tape, thereby fully sealing the tape to the duct. An exterior jacketing tape can optionally then be applied over the UL181 tape, tiger clips, and connection/duct seam. Half the width of the jacketing tape is desirably on each side of the duct seam. This jacketing tape can, for example, be 3M™ VentureClad™ 1577 CW Insulation Jacketing Tape. The overlap of the jacketing tape preferably is on the bottom, or a side, of the duct. If it is on a side, it may be desirable that the overlap face down to maximize water shedding. Finally, a squeegee is advantageously used to apply pressure to the jacketing tape, thereby fully adhering the adhesive of the jacketing tape to the duct. It is to be appreciated that while this method is preferred, the foregoing details are by no means required in all embodiments.

In certain embodiments, the invention provides a building 300 provided with an outdoor ductwork system. In these embodiments, the ductwork system is exposed to periodic contact with rain (and in some cases, also snow and hail). In certain embodiments of this nature, the building 300 has a roof 350 and at least part of the outdoor ductwork system is mounted on the roof. Reference is made to FIG. 4. In other embodiments, the outdoor ductwork system is mounted on the ground and/or mounted to one or more sides of the building 300.

The ductwork system includes a series of ducts 10, including a first duct 10 and a second duct 10. These two ducts 10 each have a multi-tube, multi-wall construction of the nature described above. The two ducts 10 are joined together by a connection characterized by the male detent of the first duct being received in the female detent of the second duct. The resulting connection is in accordance with the descriptions set forth in the present disclosure.

In the embodiment of FIG. 4 and other roof-top embodiments, the outdoor ductwork system on the building 300 includes a plurality of anchored duct supports 200 that are attached to the roof 350. With reference to FIG. 4, each anchored duct support 200 includes a top frame, a bottom frame, a left frame, and a right frame. These frames collectively surround an entire outer duct perimeter. The anchored duct supports 200 preferably are devoid of fasteners that penetrate into the ducts 10 they support.

The present duct 10 is by no means required to be used as part of an outdoor ductwork system. In other embodiments, the duct 10 is intended to be used as part of an indoor ductwork system.

FIG. 5 exemplifies embodiments of the invention wherein the HVAC duct 10 includes three composite tubes of the nature described above. In more detail, the HVAC duct 10 of the present embodiments includes an inner composite tube 890, an outer composite tube 740, and an outermost composite tube 1740. The inner composite tube 890 has an interior metal wall 90, a primary foam wall 80, and an exterior metal wall 100. The primary foam wall 80 is bonded to both the interior 90 and exterior 100 metal walls of the inner composite tube 890. The outer composite tube 740 has an interior metal wall 60, a secondary foam wall 40, and an exterior metal wall 70. The secondary foam wall 40 is bonded to both the interior 60 and exterior 70 metal walls of the outer composite tube 740. The outermost composite tube 1740 has an interior metal wall 600, a tertiary foam wall 400, and an exterior metal wall 700. The tertiary foam wall 400 is bonded to both the interior 600 and exterior 700 metal walls of the outermost composite tube 1740.

As with embodiments where the duct 10 has only two composite tubes of the described nature, the inner 890 and outer 740 composite tubes in FIG. 5 are affixed to each other, such that one is nested inside the other, in an end-offset configuration. Specifically, in the embodiment of FIG. 5, the inner composite tube 890 is nested inside the outer composite tube 740 in an end-offset configuration characterized by the inner composite tube projecting axially beyond the outer composite tube at the first end 11 of the duct 10, whereas at the second end 19 of the duct the outer composite tube projects axially beyond the inner composite tube. Thus, in the embodiment of FIG. 5, the first end 11 of the duct 10 defines a male detent having a radially-outward-facing metal engagement face 82 projecting axially beyond the interior metal wall 60 of the outer composite tube 740, whereas the second end 19 of the duct defines a female detent having a radially-inward-facing metal engagement face 42 projecting axially beyond the exterior metal wall 100 of the interior composite tube 890.

In the embodiment of FIG. 5, the outer composite tube 740 is nested inside the outermost composite tube 1740 in a flush-end configuration characterized by those two composite tubes being generally flush with each other at both the first 11 and second 19 ends of the duct 10. In more detail, at each end 11, 19 of this illustrated duct 10, the ends of the outer 740 and outermost 1740 composite tubes are substantially flush with each other.

In certain other embodiments involving three composite tubes, the outer composite tube 740 projects beyond both the inner 890 and outermost 1740 composite tubes at the first end 11 of the duct 10. Reference is made to FIG. 6B. In these embodiments, the inner 890 and outer 740 composite tubes are affixed to each other, such that one is nested inside the other, in an end-offset configuration. Specifically, the inner composite tube 890 is nested inside the outer composite tube 740 in an end-offset configuration characterized by the outer composite tube projecting axially beyond the inner composite tube at the first end 11 of the duct 10, whereas at the second end 19 of the duct the inner composite tube projects axially beyond the outer composite tube. In addition, the outer composite tube 740 is nested inside the outermost composite tube 1740 in an end-offset configuration characterized by the outer composite tube 740 projecting axially beyond the outermost composite tube 1740 at the first end 11 of the duct 10, whereas at the second end 19 of the duct the outermost composite tube projects axially beyond the outer composite tube. In these embodiments, the first end 11 of the duct 10 defines a male detent, whereas the second end 19 of the duct defines a female detent.

In the present embodiments, the male detent (defined by the outer composite tube 740) at the first end 11 of the duct 10 has both a radially-outward-facing metal engagement face (defined by metal wall 70) and a radially-inward-facing metal engagement face (defined by metal wall 60). The radially-outward-facing metal engagement face projects axially beyond the interior metal wall 600 of the outermost composite tube 1740, and the radially-inward-facing metal engagement face projects axially beyond the exterior metal wall 90 of the inner composite tube 890. In these embodiments, the female detent at the second end 19 of the duct 10 has both a radially-inward-facing metal engagement face (defined by metal wall 600) and a radially-outward facing engagement face (defined by metal wall 100).

In still other embodiments involving three composite tubes, the outermost composite tube 1740 projects axially beyond the outer 740 and inner 890 composite tubes at the first end 11 of the duct 10. In these embodiments, the outer 740 and outermost 1740 composite tubes are affixed to each other, such that one is nested inside the other, in an end-offset configuration. Specifically, the outer composite tube 740 is nested inside the outermost composite tube 1740 in an end-offset configuration characterized by the outermost composite tube projecting axially beyond the outer composite tube at the first end 11 of the duct 10, whereas at the second end 19 of the duct the outer composite tube projects axially beyond the outermost composite tube. Preferably, the inner composite tube 890 is nested inside the outer composite tube 740 in a flush-end configuration characterized by those composite tubes being generally flush with each other at both the first 11 and second 19 ends of the duct 10. In such cases, at each end 11, 19 of the duct 10, the ends of the inner 890 and outer 740 composite tubes are substantially flush with each other.

Figure 6C:
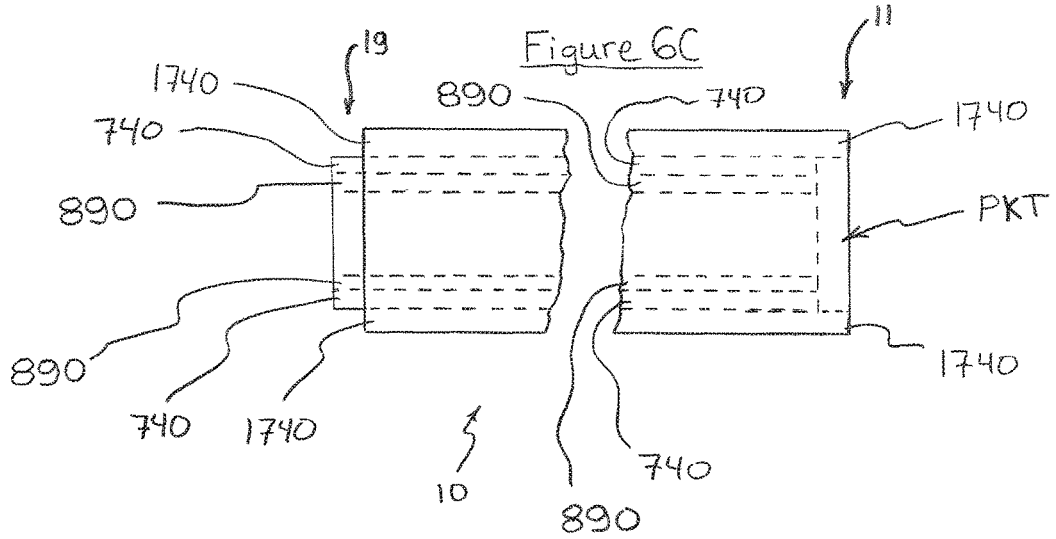
FIG. 6C is a schematic broken-away side view of a duct in accordance with still another embodiment of the invention.

Thus, the invention provides a variety of embodiments wherein an HVAC duct 10 comprises three composite tubes 890, 740, 1740. In these embodiments, the inner composite tube 890 is nested inside the outer composite tube 740, and the outer composite tube is nested inside the outermost composite tube 1740. In more detail, the three composite tubes 890, 740, 1740 are secured in an end-offset configuration characterized by a desired one of the three composite tubes projecting axially beyond the other two of the three composite tubes at the first end 11 of the duct 10, whereas at the second end 19 of the duct the other two of the three composite tubes project axially beyond the desired one of the three composite tubes. Reference is made to FIGS. 6A-6C, which depict three embodiments of this nature. In these three figures, for ease of illustration, the different walls (i.e., the foam and metal walls) of the composite tubes are not shown independently.

In the present embodiments, a leading one of the first 11 and second 19 ends of the duct 10 defines a male detent (the end defining the male detent is referred to herein as the "leading" end of the duct), while a trailing one of the first and second ends of the duct defines a female detent (the end defining the female detent is referred to herein as the "trailing" end of the duct). Preferably, the male detent includes a radially-outward-facing metal engagement face (defined by metal wall 100 in FIGS. 5 and 6A, defined by metal wall 70 in FIGS. 6B and 6C), and the female detent includes a radially-inward-facing metal engagement face (defined by metal wall 60 in FIGS. 5 and 6A, defined by metal wall 600 in FIGS. 6B and 6C).

With continued reference to FIGS. 5 and 6A-6C, it can be appreciated that the female detent includes an axially-outward-facing open pocket PKT surrounded by the radially-inward-facing metal engagement face. In the embodiments of FIGS. 5, 6A, and 6C, the pocket PKT has a circular cross-sectional configuration (i.e., in a cross section taken perpendicular to axis A). In the embodiment of FIG. 6B, the pocket PKT has an annular cross-sectional configuration.

In the present embodiments, two of the three composite tubes 890, 740, 1740 preferably are in flush-end positions characterized by those two composite tubes being substantially flush with each other at both the first 11 and second 19 ends of the duct 10. In the embodiment of FIGS. 5 and 6A, for example, the outer 740 and outermost 1740 composite tubes are in flush-end positions. That is, these two composite tubes are substantially flush with each other at both the first 11 and second 19 ends of the duct 10. In the embodiment of FIG. 6B, the inner 890 and outermost 1740 composite tubes are in flush-end positions, i.e., these two composite tubes are substantially flush with each other at both the first 11 and second 19 ends of the duct 10. In the embodiment of FIG. 6C, the inner 890 and outer 740 composite tubes are in flush-end positions. Thus, these two composite tubes are substantially flush with each other at both the first 11 and second 19 ends of the duct 10.

In the foregoing embodiments involving an HVAC duct 10 having three composite tubes 890, 740, 1740, the duct can be provided as part of an HVAC ductwork assembly that further includes another duct of the nature described above. In such cases, the two ducts (i.e., the "first" and "second" ducts) can advantageously be joined together by a connection characterized by the male detent being received in the female detent. This involves the radially-outward-facing metal engagement face of the male detent being nested inside, so as to contact, the radially-inward-facing metal engagement face of the female detent.

In the embodiments described above, the foam walls of the duct 10 may initially be exposed at both ends of the duct (i.e., a foam end face may be exposed at each end of each foam wall). To protect the foam end faces at each end of the duct, UL181 tape can be applied so as to cover both the male and female ends of the duct 10. This can advantageously leave all the foam concealed.

While some preferred embodiments of the invention have been described, it should be understood that various changes, adaptations and modifications may be made therein without departing from the spirit of the invention and the scope of the appended claims.

What is claimed is:

1. An HVAC duct having opposed first and second ends and a central span extending between the first and second ends, the HVAC duct being a single length of duct having a length of between 3 feet and 13 feet, the HVAC duct comprising an inner composite tube and an outer composite tube, the inner composite tube having an interior metal wall, a primary foam wall, and an exterior metal wall, the interior and exterior metal walls of the inner composite tube each having a thickness of between 15 micrometers and 300 micrometers, the primary foam wall being bonded to both the interior and exterior metal walls of the inner composite tube so as to form a single unitary multi-wall tube extending from the first end of the duct to the second end of the duct, the outer composite tube having an interior metal wall, a secondary foam wall, and an exterior metal wall, the interior and exterior metal walls of the outer composite tube each having a thickness of between 15 micrometers and 300 micrometers, the secondary foam wall being bonded to both the interior and exterior metal walls of the outer composite tube so as to form a single unitary multi-wall tube extending from the first end of the duct to the second end of the duct, the inner composite tube being nested inside the outer composite tube in an end-offset configuration characterized by the inner composite tube projecting axially beyond the outer composite tube at the first end of the duct whereas at the second end of the duct the outer composite tube projects axially beyond the inner composite tube, such that the first end of the duct defines a male detent having a radially-outward-facing metal engagement face projecting axially beyond the interior metal wall of the outer composite tube whereas the second end of the duct defines a female detent having a radially-inward-facing metal engagement face projecting axially beyond the exterior metal wall of the interior composite tube, each of the inner and outer composite tubes having a folded construction such that each said composite tube is formed by a flat panel folded into a rectangular configuration, the HVAC duct having a weight per unit surface area of less than two pounds per square foot.

2. The HVAC duct of claim 1 wherein the inner composite tube is nested inside the outer composite tube such that the exterior metal wall of the inner composite tube and the interior metal wall of the outer composite tube contact each other.

3. The HVAC duct of claim 1 wherein the inner composite tube has substantially the same length as the outer composite tube.

4. The HVAC duct of claim 1 wherein the interior metal wall, the primary foam wall, and the exterior metal wall of the inner composite tube each have substantially the same length, and the interior metal wall, the secondary foam wall, and the exterior metal wall of the outer composite tube each have substantially the same length.

5. The HVAC duct of claim 4 wherein the interior metal wall, the primary foam wall, and the exterior metal wall of the inner composite tube, as well as the interior metal wall, the secondary foam wall, and the exterior metal wall of the outer composite tube, all have substantially the same length.

6. The HVAC duct of claim 1 wherein the duct has an R value of at least 6.

7. The HVAC duct of claim 1 wherein the interior and exterior metal walls of the inner composite tube, as well as the interior and exterior metal walls of the outer composite tube, each comprise aluminum, whereas the primary and secondary foam walls each comprise a phenolic resin.

8. The HVAC duct of claim 1 wherein the inner composite tube has the same length as the outer composite tube.

9. The HVAC duct of claim 1 wherein the duct has a sloped roof.

10. The HVAC duct of claim 9 wherein the sloped roof has two faces each having a pitch in a range of from about 5 degrees to about 30 degrees.

11. The HVAC duct of claim 1 wherein the inner composite tube and the outer composite tube are affixed to each other so as to be locked against relative axial or rotational movement relative to each other.

12. The HVAC duct of claim 1 wherein the primary and secondary foam walls each have a density in a range of from 40 to 80 $kg/m^3$.

13. An HVAC ductwork assembly comprising a first duct and a second duct, the first duct having opposed first and second ends and a central span extending between the first and second ends of the first duct, the first duct being a single length of duct having a length of between 3 feet and 13 feet, the first duct comprising an inner composite tube and an outer composite tube, the inner composite tube having an interior metal wall, a primary foam wall, and an exterior metal wall, the interior and exterior metal walls of the inner composite tube each having a thickness of between 15 micrometers and 300 micrometers, the primary foam wall being bonded to the interior and exterior metal walls of the inner composite tube so as to form a single unitary multi-wall tube extending from the first end of the first duct to the second end of the first duct, the outer composite tube having an interior metal wall, a secondary foam wall, and an exterior metal wall, the interior and exterior metal walls of the outer composite tube each having a thickness of between 15 micrometers and 300 micrometers, the secondary foam wall being bonded to both the interior and exterior metal walls of the outer composite tube so as to form a single unitary multi-wall tube extending from the first end of the first duct to the second end of the first duct, the inner composite tube being nested inside the outer composite tube in an end-offset configuration characterized by the inner composite tube projecting beyond the outer composite tube at the first end of the first duct whereas at the second end of the first duct the outer composite tube projects beyond the inner composite tube, such that the first end of the first duct defines a male detent having a radially-outward-facing metal engagement face projecting axially beyond the interior metal wall of the outer composite tube of the first duct whereas the second end of the first duct defines a female detent having a radially-inward-facing metal engagement face projecting axially beyond the exterior metal wall of the inner composite tube of the first duct, each of the inner and outer composite tubes having a folded construction such that each said composite tube is formed by a flat panel folded into a rectangular configuration;

the second duct having opposed first and second ends and a central span extending between the first and second ends of the second duct, the second duct being a single length of duct having a length of between 3 feet and 13 feet, the second duct comprising an inner composite tube and an outer composite tube, the inner composite tube of the second duct having an interior metal wall, a primary foam wall, and an exterior metal wall, the interior and exterior metal walls of the inner composite tube of the second duct each having a thickness of between 15 micrometers and 300 micrometers, the primary foam wall of the second duct being bonded to the interior and exterior metal walls of the inner composite tube so as to form a single unitary multi-wall tube extending from the first end of the second duct to the second end of the second duct, the outer composite tube of the second duct having an interior metal wall, a secondary foam wall, and an exterior metal wall, the interior and exterior metal walls of the outer composite tube of the second duct each having a thickness of between 15 micrometers and 300 micrometers, the secondary foam wall of the second duct being bonded to the interior and exterior metal walls of the outer composite tube of the second duct so as to form a single unitary multi-wall tube extending from the first end of the second duct to the second end of the second duct, the inner composite tube of the second duct being nested inside the outer composite tube of the second duct in an end-offset configuration characterized by the inner composite tube of the second duct projecting beyond the outer composite tube of the second duct at the first end of the second duct whereas at the second end of the second duct the outer composite tube of the second duct projects beyond the inner composite tube of the second duct, such that the first end of the second duct defines a male detent having a radially-outwardly-facing metal engagement face projecting axially beyond the interior metal wall of the outer composite tube whereas the second end of the second duct defines a female detent having a radially-inwardly-facing metal engagement face projecting axially beyond the exterior metal wall of the inner composite tube, each of the inner and outer composite tubes of the second duct having a folded construction such that each said composite tube of the second duct is formed by a flat panel folded into a rectangular configuration;

the first duct and the second duct being joined together by a connection characterized by the male detent of the first duct being received in the female detent of the second duct such that the exterior metal wall of the inner composite tube of the first duct is nested inside, so as to contact, the interior metal wall of the outer composite tube of the second duct the first and second ducts each having a weight per unit surface area of less than two pounds per square foot.

14. The HVAC ductwork assembly of claim 13 wherein the connection is characterized by a radial inner interface, an axial interface, and a radial outer interface, the radial inner interface being located between the primary foam wall of the inner composite tube of the first duct and the primary foam wall of the inner composite tube of the second duct, the axial interface being located between the exterior metal wall of the inner composite tube of the first duct and the interior metal wall of the outer composite tube of the second duct, the radial outer interface being located between the secondary foam wall of the outer composite tube of the first duct and the secondary foam wall of the outer composite tube of the second duct.

15. The HVAC ductwork assembly of claim 14 wherein the axial interface extends between the radial inner interface and the radial outer interface.

16. The HVAC ductwork assembly of claim 15 wherein the connection further comprises first and second beads of sealant, the first and second beads of sealant being positioned at locations that are spaced apart both axially and radially, the first bead of sealant being located at the radial inner interface, the second bead of sealant being located at the radial outer interface.

17. The HVAC ductwork assembly of claim 13 wherein the inner composite tube of the first duct is nested inside the outer composite tube of the first duct such that the exterior metal wall of the inner composite tube of the first duct and the interior metal wall of the outer composite tube of the first duct contact each other, and the inner composite tube of the second duct is nested inside the outer composite tube of the second duct such that the exterior metal wall of the inner composite tube of the second duct and the interior metal wall of the outer composite tube of the second duct contact each other.

18. The HVAC ductwork assembly of claim 13 wherein the inner composite tube of the first duct has substantially the same length as the outer composite tube of the first duct, and the inner composite tube of the second duct has substantially the same length as the outer composite tube of the second duct.

19. The HVAC ductwork assembly of claim 13 wherein the interior metal wall, the primary foam wall, and the exterior metal wall of the inner composite tube of the first duct all have substantially the same length, wherein the interior metal wall, the secondary foam wall, and the exterior metal wall of the outer composite tube of the first duct all have substantially the same length, wherein the interior metal wall, the primary foam wall, and the exterior metal wall all have substantially the same length, and wherein the interior metal wall, the secondary metal wall, and the exterior metal wall of the second duct all have substantially the same length.

20. The HVAC ductwork assembly of claim 13 wherein the first and second ducts each have an R value of at least 6.

21. The HVAC ductwork assembly of claim 13 wherein the interior metal wall of the first duct, the exterior metal wall of the first duct, the interior metal wall of the second duct, and the exterior metal wall of the second duct all comprise aluminum, whereas the primary foam wall of the first duct, the secondary foam wall of the first duct, the primary foam wall of the second duct, and the secondary foam wall of the second duct all comprise a phenolic resin.

22. The HVAC ductwork assembly of claim 13 wherein the inner composite tube of the first duct and the outer composite tube of the first duct have the same length, and wherein the inner composite tube of the second duct and the outer composite tube of the second duct have the same length.

23. The HVAC ductwork assembly of claim 13 wherein the inner composite tube and the outer composite tube of the first duct are affixed to each other so as to be locked against relative axial or rotational movement relative to each other, and wherein the inner composite tube and the outer composite tube of the second duct are affixed to each other so as to be locked against relative axial or rotational movement relative to each other.

24. The HVAC ductwork assembly of claim 13 wherein the primary and secondary foam walls of each of the first and second ducts each have a density in a range of from 40 to 80 $kg/m^3$.

25. The HVAC ductwork assembly of claim 13 wherein the first and second ducts are connected by sealant, glue, and/or double-sided tape.

26. An HVAC duct having opposed first and second ends and a central span extending between the first and second ends, the HVAC duct being a single length of duct having a length of between 3 feet and 13 feet, the HVAC duct comprising an inner composite tube, an outer composite tube, and an outermost composite tube, the inner composite tube having an interior metal wall, a primary foam wall, and an exterior metal wall, the interior and exterior metal walls of the inner composite tube each having a thickness of between 15 micrometers and 300 micrometers, the primary foam wall being bonded to both the interior and exterior metal walls of the inner composite tube so as to form a single unitary multi-wall tube extending from the first end of the duct to the second end of the duct, the outer composite tube having an interior metal wall, a secondary foam wall, and an exterior metal wall, the interior and exterior metal walls of the outer composite tube each having a thickness of between 15 micrometers and 300 micrometers, the secondary foam wall being bonded to both the interior and exterior metal walls of the outer composite tube so as to form a single unitary multi-wall tube extending from the first end of the duct to the second end of the duct, the outermost composite tube having an interior metal wall, a tertiary foam wall, and an exterior metal wall, the interior and exterior metal walls of the outermost composite tube each having a thickness of between 15 micrometers and 300 micrometers, the tertiary foam wall being bonded to both the interior and exterior metal walls of the outermost composite tube so as to form a single unitary multi-wall tube extending from the first end of the duct to the second end of the duct, wherein the inner composite tube is nested inside the outer composite tube, and the outer composite tube is nested inside the outermost composite tube, said three composite tubes being secured in an end-offset configuration characterized by a desired one of said three composite tubes projecting axially beyond the other two of said three composite tubes at the first end of the duct, whereas at the second end of the duct said other two of said three composite tubes project axially beyond said desired one of said three composite tubes, such that a leading one of the first and second ends of the duct defines a male detent while a trailing one of the first and second ends of the duct defines a female detent, the male detent comprising a radially-outward-facing metal engagement face, the female detent comprising a radially-inward-facing metal engagement face, each of said composite tubes having a folded construction such that each said composite tube is formed by a flat panel folded into a rectangular configuration, the HVAC duct having a weight per unit surface area of less than two pounds per square foot.

27. The HVAC duct of claim 26 wherein the female detent comprises an axially-outward-facing open pocket surrounded by the radially-inward-facing metal engagement face.

28. The HVAC duct of claim 26 wherein two of said three composite tubes are in flush-end positions characterized by those two composite tubes being substantially flush with each other at both the first and second ends of the duct.

29. The HVAC duct of claim 26 wherein the HVAC duct is part of an HVAC ductwork assembly that further includes another duct, said two ducts being defined as first and second ducts, the first and second ducts being joined together by a connection characterized by the male detent being received in a female detent of the second duct such that the radially-outward-facing metal engagement face of the male detent is nested inside, so as to contact, a radially-inward-facing metal engagement face of the female detent.

30. The HVAC duct of claim 26 wherein the inner composite tube, outer composite tube, and outermost composite tube have the same length.

* * * * *